US009937391B2

(12) United States Patent
Takechi

(10) Patent No.: US 9,937,391 B2
(45) Date of Patent: Apr. 10, 2018

(54) GOLF CLUB HEAD

(71) Applicant: Bridgestone Sports Co., Ltd., Tokyo (JP)

(72) Inventor: Takaharu Takechi, Tokyo (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 15/142,042

(22) Filed: Apr. 29, 2016

(65) Prior Publication Data

US 2016/0332042 A1 Nov. 17, 2016

(30) Foreign Application Priority Data

May 15, 2015 (JP) ..... 2015-100278

(51) Int. Cl.
*A63B 53/04* (2015.01)
*A63B 60/52* (2015.01)

(52) U.S. Cl.
CPC ..... *A63B 53/0466* (2013.01); *A63B 60/52* (2015.10); *A63B 2053/045* (2013.01); *A63B 2053/0408* (2013.01); *A63B 2053/0433* (2013.01)

(58) Field of Classification Search
USPC ..... 473/324–350
See application file for complete search history.

(56) References Cited

U.S. PATENT DOCUMENTS 5,213,328 A * 5/1993 Long ..... A63B 53/04 473/346
5,292,129 A * 3/1994 Long ..... A63B 53/04 473/346
6,319,148 B1 * 11/2001 Tom ..... A63B 53/00 473/290
6,780,121 B2 * 8/2004 Herber ..... A63B 53/0466 473/242
7,887,433 B2 * 2/2011 Hoffman ..... A63B 53/0466 473/327
8,409,030 B2 * 4/2013 Hoffman ..... A63B 53/0466 473/332
8,827,834 B2 9/2014 Horacek et al.
9,174,103 B2 * 11/2015 Curtis ..... A63B 53/08

FOREIGN PATENT DOCUMENTS

JP 2003088601 A 3/2003
JP 2006095055 A 4/2006
JP 2009233266 A 10/2009

* cited by examiner

*Primary Examiner* — Alvin Hunter
(74) *Attorney, Agent, or Firm* — Muncy, Geissler, Olds & Lowe, P.C.

(57) ABSTRACT

A hollow golf club head having a face part, a sole part, a side part, a crown part, and a hosel part, comprises one or more of inner ribs that are disposed on at least one of the sole part and the side part and that inwardly project from an inner surface of the one, one or more of outer ribs that are disposed on at least the one of the sole part and the side part and that outwardly project from an outer surface of the one, and one of the inner ribs is arranged between the outer ribs in a toe-to-heel direction.

7 Claims, 12 Drawing Sheets

GOLF CLUB HEAD

CROSS REFERENCE TO RELATED APPLICATIONS

This application claims priority under 35 USC 119 to Japanese Patent Application No. 2015-100278 filed on May 15, 2015, the entire contents which are incorporated herein by reference.

TECHNICAL FIELD

The present invention relates to a hollow golf club head and, more specifically, to a hollow golf club head in which ribs are provided in at least one of the sole part and the side part.

BACKGROUND

The head of a wood-type golf club such as a driver or a fairway wood is often hollow and made of metal. A hollow wood-type golf club head has a face part for striking the ball, a crown part comprising the upper surface part of the golf club head, a sole part comprising the bottom surface part of the golf club head, a side part comprising the side surface part on the toe side, the back side and the heel side, and a hosel part. A shaft is inserted into the hosel part and secured using an adhesive. Recently, a golf club known as a utility club has become widely available. One type of utility golf club that has become widely available is a golf club with a hollow head resembling that of a wood-type golf club head (that is, having a face part, a sole part, a side part, a crown part, and a hosel part).

Aluminum alloys, stainless steel, and titanium alloys are used as the metal constituting the hollow golf club head, but titanium alloys have become more widely used in recent years.

The hollow golf club head described in Patent Document 1 includes ribs provided on the inner surface of the sole part in a direction linking the face part and the back-side of the side part. The hollow golf club head described in Patent Document 2 includes receiving parts provided inwardly near the toe and near the heel so as to interpose the rearmost portion of the side part on the back side, projection parts projecting inwardly on the back side of the side part, ribs provided in the toe-to-heel direction between the receiving parts and the projection parts, and ribs provided in the top-to-sole direction from each receiving part and projection part. The hollow golf club head described in Patent Document 3 includes ribs provided so as to extend from the inner surface of the sole part towards the inner surface of the crown part.

The hollow golf club head described in Patent Document 4 includes a restraint member extending from the inner surface of the crown part towards the sole part. The hollow golf club head described in Patent Document 5 includes ribs provided linearly on both the outer surface and the inner surface of the golf club head.

RELATED ART

Patent Documents

JP Patent Application Publication 2003-88601
JP Patent Application Publication 2006-95055
JP Patent Application Publication 2009-233266
U.S. Pat. No. 8,827,834
U.S. Pat. No. 8,409,030

SUMMARY

It is an object of the present invention to provide a golf club head able to increase the rigidity of at least one of the sole part and the side part, and able to increase the launch angle of a struck golf ball.

A hollow golf club head, which is disclosed in the application, having a face part, a sole part, a side part, a crown part, and a hosel part, comprising one or more of inner ribs that are disposed on at least one of the sole part and the side part and that inwardly project from an inner surface of the one, one or more of outer ribs that are disposed on at least the one of the sole part and the side part and that outwardly project from an outer surface of the one, and one of the inner ribs is arranged between the outer ribs in a toe-to-heel direction.

In another hollow golf club head above, wherein the outer ribs are two or more, and at least two of the outer ribs are separately arranged.

Another hollow golf club head, which is disclosed in the application, having a face part, a sole part, a side part, a crown part, and a hosel part, comprising: one or more of inner ribs that are disposed on at least one of the sole part and the side part and that inwardly project from an inner surface of the one, one or more of outer ribs that are disposed on at least the one of the sole part and the side part and that outwardly project from an outer surface of the one, and one of the outer ribs is arranged between the inner ribs in a toe-to-heel direction.

In another hollow golf club head above, wherein the inner ribs are two or more, and at least two of the inner ribs are separately arranged.

In another golf club head disclosed in the application, the inner ribs and the outer ribs each have an extending portion in a face-to-back direction.

In another golf club head disclosed in the application, at least one of the inner ribs and the outer ribs has a portion inclined with respect to a face-to-back direction.

In another golf club head disclosed in the application, a recess part, which is inwardly recessed, is provided on at least one of the sole part and the side part, and one of the outer ribs is arranged in the recess part.

In the golf club head of the present invention, inner ribs and outer ribs are provided in at least one of the sole part and the side part, and the rigidity of at least one of the sole part and the side part is increased. As a result, the crown part of the golf club head of the present invention is deflected relatively easily when a golf ball is struck and the launch angle of the golf ball is increased.

In the present invention, an outer rib is placed between inner ribs or an inner rib is placed between outer ribs, thereby further increasing the rigidity of at least one of the sole part and the side part, and further facilitating deflection of the crown part when a golf ball is struck.

DETAILED DESCRIPTIONS OF THE EMBODIMENTS

Figure 1:
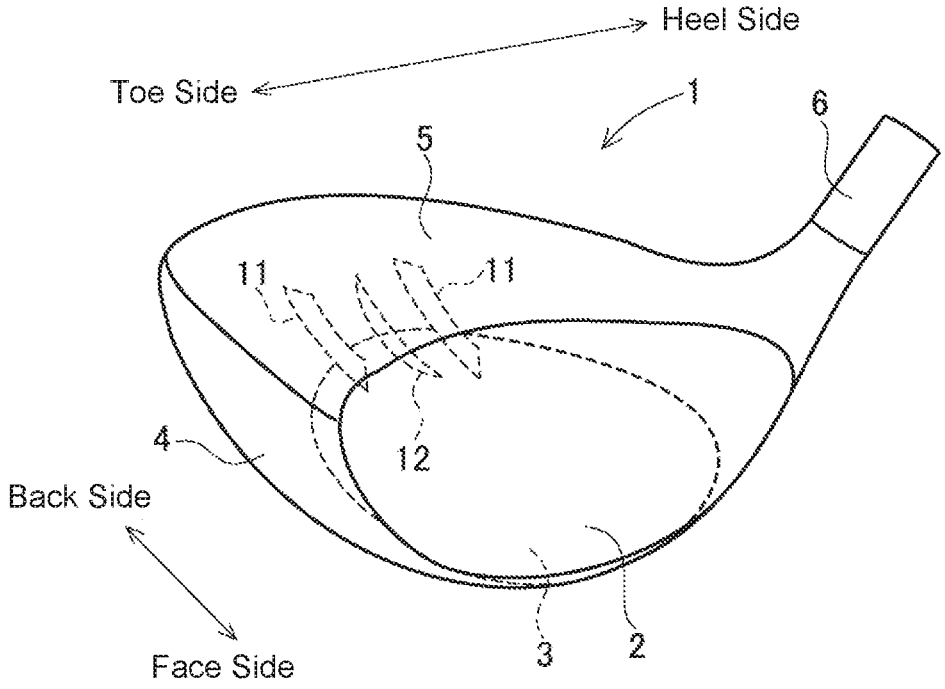
FIG. 1 is a perspective view of a golf club head according to an embodiment of the present invention.

The following is an explanation of the golf club heads in embodiments of the present invention with reference to the drawings.

The golf club head 1 in FIG. 1 through FIG. 4B is a hollow driver head having a face part 2, a sole part 3, a side part 4, a crown part 5, and a hosel part 6. In the present embodiment, the golf club head 1 is integrally comprised of metal. Examples of metals include titanium, titanium alloys, aluminum alloys, and stainless steel, but titanium alloys are preferred. Note that a part of the golf club head 1 can be comprised of a non-metal material such as a fiber-reinforced resin. A part of the golf club head 1, for example, the sole part 3 and the side part 4, may be provided with a decorative element or name plate made of, for example, a synthetic resin, rubber, or elastomer.

The face part 2 is the surface which strikes the ball. The sole part 3 comprises the bottom surface part of the golf club head, and the crown part 5 comprises the upper surface part of the golf club head. The side part 4 comes into contact with the sole part 3 and the crown part 5, and extends from the toe side 1*t* of the golf club head 1 to the heel side 1*h* via the back-side 1*b*. The shaft is secured to the hosel part 6.

Figure 4A:
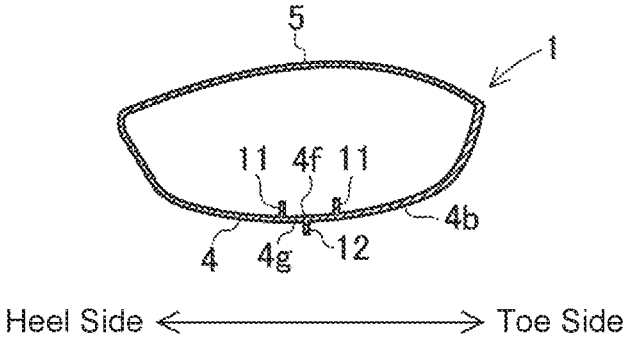
FIG. 4A is a cutaway end view along line IV-IV in FIG. 2.

In the present embodiment, inner ribs 11 and an outer rib 12 are provided from the back-side portion 3*b* of the sole part 3 towards the back-side portion 4*b* of the side part 4. As shown in FIG. 4A, the inner ribs 11 project from the sole part to an inside of the head, may be recited as inwardly projecting. The outer rib 12 projects in the opposite direction from the inner ribs 11, may be recited as outwardly projecting.

Figure 3A:
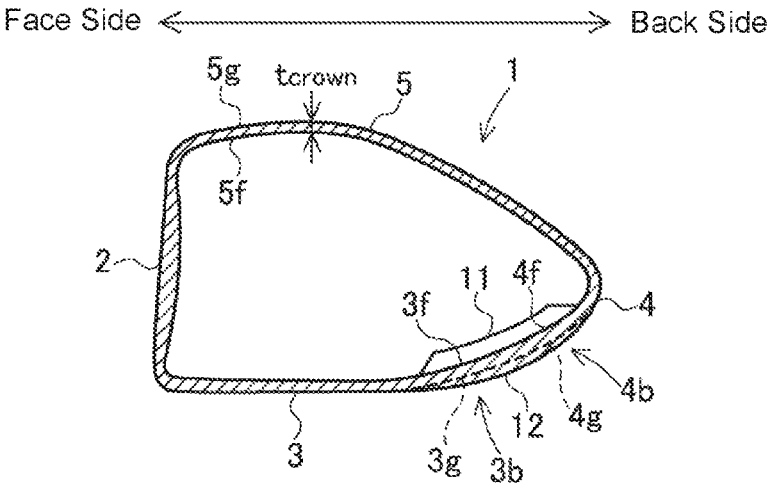
FIG. 3A is a sectional view along line in FIG. 2.
Figure 3B:
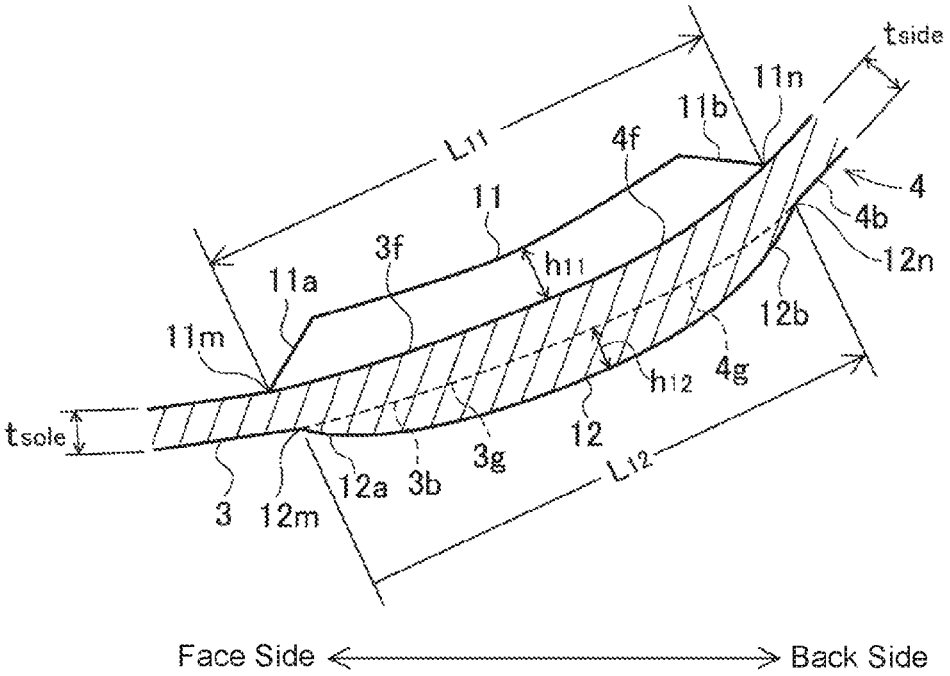
FIG. 3B is an enlarged view of a portion of FIG. 3A.

In the present embodiment, two of the inner ribs 11 are provided and one of the outer rib 12 is provided. In the present embodiment, the inner ribs 11 and the outer rib 12 all extend in the face-to-back direction. As shown in FIG. 3A and FIG. 3B, the inner ribs 11 are provided from the inner surface 3*f* of the back-side portion 3*b* of the sole part 3 towards the inner surface 4*f* of the back-side portion 4*b* of the side part 4. The outer rib 12 is provided from the outer surface 3*g* of the back-side portion 3*b* of the sole part 3 towards the outer surface 4*g* of the back-side portion 4*b* of the side part 4.

The outer rib 12 is arranged near the middle of the golf club head 1 in the toe-to-heel direction. One of the two inner ribs 11 is arranged on the toe side of the outer rib 12, and the other one is arranged on the heel side of the outer rib 12.

The portion 11*a* of the inner ribs 11 near the end part 11*m* on the face side gradually increases in height from the inner surface 3*f* of the sole part 3 towards the back side, and the portion 11*b* near the end part 11*n* on the back side increases in height from the inner surface 4*f* of the back-side portion 4*b* of the side part 4 towards the face side. The length of the inner ribs 11, that is, the straight-line distance $L_{11}$ connecting the face-side end part 11*m* to the back-side end part 11*n* of the inner ribs 11 is preferred to be 5 mm or more, specifically 10 mm or more and to be 100 mm or less, specifically 40 mm or less.

The portion 12*a* of the outer rib 12 near the end part 12*m* on the face side gradually increases in height from the outer surface 3*g* of the sole part 3 towards the back side, and the portion 12*b* near the end part 12*n* on the back side increases in height from the outer surface 4*g* of the back-side portion 4*b* of the side part 4 towards the face side.

The length of the outer rib 12, that is, the straight-line distance $L_{12}$ connecting the face-side end part 12*m* to the back-side end part 12*n* of the outer rib 12 is preferred to be 5 mm or more, specifically 10 mm or more and to be 80 mm or less, specifically 30 mm or less. The length $L_{11}$ of the inner ribs 11 and the length $L_{12}$ of the outer ribs 12 may be the same or different.

There are no particular restrictions on the average height $h_{11}$ of the inner ribs 11 from the inner surface 3*f* of the sole part 3 or the inner surface 4*f* of the side part 4. However, it may be preferred to be 0.5 mm or more, specifically 2 mm or more and to be 10 mm or less, specifically 5 mm or less.

Figure 4B:
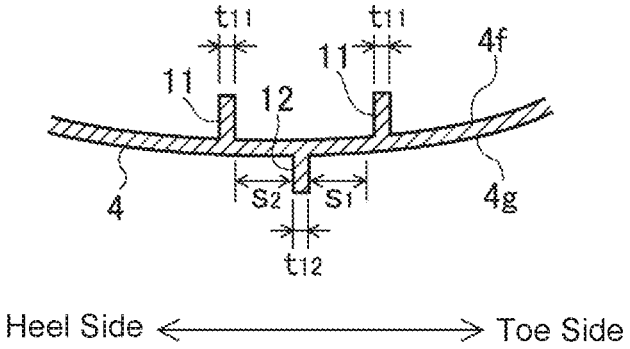
FIG. 4B is an enlarged view of a portion of FIG. 4A.

The width (thickness) $t_{11}$ of the inner ribs 11, which is shown in FIG. 4B, may be uniform along the entire length of the inner ribs 11 or may be partially different in certain portions. There are no particular restrictions on the average width (thickness) $t_{11}$ of the inner ribs 11. However, it may be preferred to be 0.5 mm or more, specifically 0.8 mm or more and to be 3 mm or less, specifically 2 mm or less.

There are no particular restrictions on the average height $h_{12}$ of the outer rib 12 from the outer surface 3*g* of the sole part 3 or the outer surface 4*g* of the side part 4. However, it may be preferred to be 0.3 mm or more, specifically 0.5 mm or more and to be 10 mm or less, specifically 5 mm or less.

The width (thickness) $t_{12}$ of the outer rib 12 may be uniform along the entire length of the outer rib 12 or may be partially different in certain portions. There are no particular restrictions on the average width (thickness) $t_{12}$ of the outer rib 12. However, it may be preferred to be 0.5 mm or more, specifically 0.8 mm or more and to be 4 mm or less, specifically 2 mm or less.

In the present embodiment, the inner ribs 11 and the outer rib 12 are parallel. There are no particular restrictions on the intervals $S_1$, $S_2$ between the inner ribs 11 and the outer rib 12. However, it may be preferred to be 1 mm or more, specifically 5 mm or more and to be 40 mm or less, specifically 20 mm or less.

The interval $S_1$ between the outer rib 12 and the inner rib 11 on the toe side may be the same as or different from the interval $S_2$ between the outer rib 12 and the inner rib 11 on the heel side.

Figure 2:
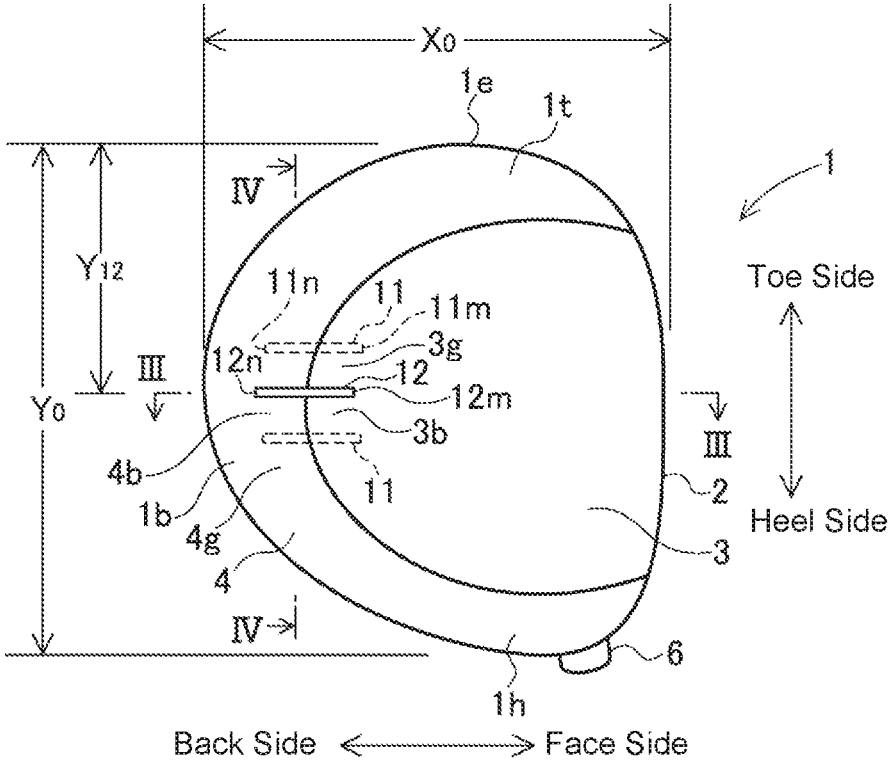
FIG. 2 is a bottom view of the golf club head in FIG. 1.

When the golf club head 1 is viewed from the bottom surface (that is, when the sole part 3 is arranged on a horizontal plane at the lie angle and the real loft angle prescribed for the golf club head 1 and the head is viewed from below perpendicular to the horizontal plane), there are no restrictions on the maximum length $X_0$, see FIG. 2, in the face-to-back direction, but it may be 140 mm or less. Also, when the golf club head 1 is viewed from the bottom surface, there are no restrictions on the maximum length $Y_0$ in the toe-to-heel direction perpendicular to the face-to-back direction, but it may be 150 mm or less. There are no particular restrictions on the distance $Y_{12}$ in the toe-to-heel direction from the toe part 1*e* farthest on the toe side to the outer rib 12, but it may be 30% of $Y_0$ or more, specifically 40% or more and be 70% of $Y_0$ or less, specifically 60% or less.

Noted is one example of the toe-to heel direction and the face-to-back direction. Where a shaft is inserted into the hosel part 6 and the golf club head 1 is addressed on a golf club head angle measurement gauge, the sole part 3 of the golf club head 1 is grounded on the measurement gauge with the regulated lie angle and the real loft angle. With the position, seen from the top view of the golf club head, a perpendicular direction to the center axis line of the shaft is defined as the face-to-back direction, and a parallel direction to the center axis line of the shaft is as the toe-to-heel direction.

When the golf club head 1 is comprised of titanium alloy, there are no particular restrictions on the thickness $t_{sole}$ of the sole part 3, but it may be from 0.5 to 2.5 mm. There are no particular restrictions on the thickness $t_{side}$ of the side part 4, but it may be from 0.3 to 2.0 mm. There are no particular restrictions on the thickness $t_{crown}$ of the crown part 5, but it may be from 0.3 to 2.0 mm.

In order to improve the deflection of the crown part 5 of the golf club head 1, a less rigid lower part may be provided on the crown part 5. An example of a less rigid lower part is a groove. For example, one or more grooves may be formed on at least one of the inner surface 5*f* and the outer surface 5*g* of the crown part 5 so as to extend in the toe-to-heel direction.

In a golf club head 1 thus constituted, inner ribs 11 and an outer rib 12 are provided so as to continuously extend from the back-side portion 3*b* of the sole part 3 towards the back-side portion 4*b* of the side part 4, thereby increasing the rigidity of the back-side portion 3*b* of the sole part 3 and the back-side portion 4*b* of the side part 4. Therefore, when a golf ball is struck by this golf club head 1, the crown part 5 is easily deflected, the launch angle of the golf ball is increased, and the flight distance is extended.

Note that, in the present embodiment, both the inner ribs 11 and the outer rib 12 are provided from the sole part 3 towards the side part 4. However, some or all of the ribs 11, 12 may be provided only in the back-side portion 3*b* of the sole part 3 or in the back-side portion 4*b* of the side part 4. Also, in the present embodiment, the inner ribs 11 and the outer rib 12 extend in the face-to-back direction. However, at least some of the ribs may extend in a direction inclined with respect to the face-to-back direction (that is, in an oblique direction). At least a portion of some or all of the ribs 11, 12 may also be non-linear. The number of inner ribs 11 and outer ribs 12 may also be changed. An inner rib may also be placed between a plurality of outer ribs 12.

Referring to FIG. 5 through FIG. 11, the following is a description of golf club heads in embodiments of the present invention in which the shape, arrangement, and number of inner ribs and outer ribs differ from those in the embodiment described above.

Figure 5A:
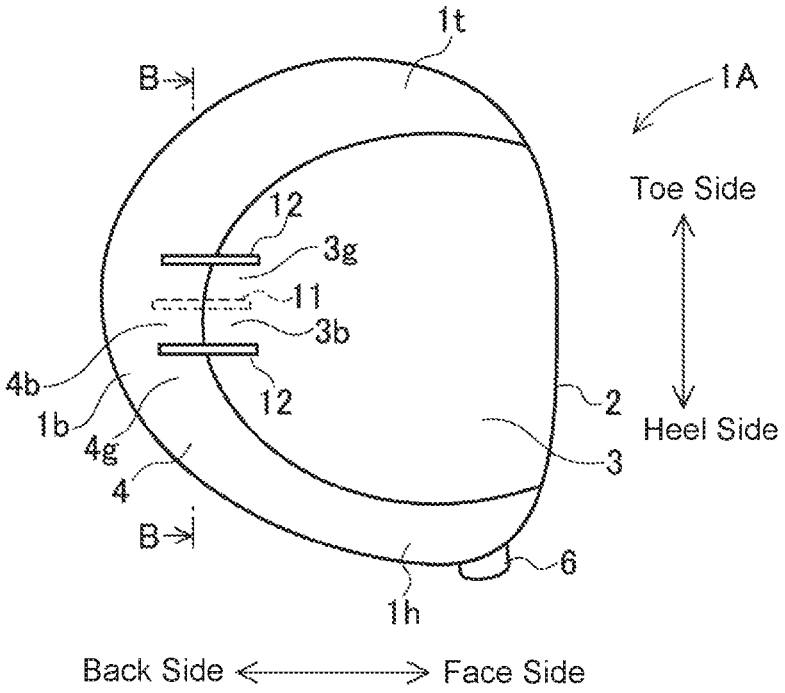
FIG. 5A is a bottom view of the golf club head in another embodiment of the present invention.
Figure 5B:
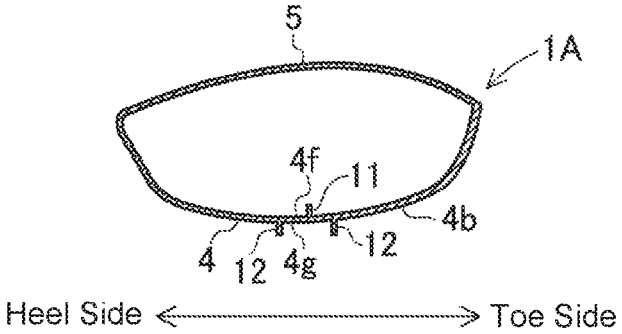
FIG. 5B is a cutaway end view along line B-B in FIG. 5A.

FIG. 5A is a bottom view of the golf club head 1A, and FIG. 5B is a cutaway end view along line B-B in FIG. 5A. This golf club head 1A is the opposite of the golf club head 1 in FIG. 1 through FIG. 4B in that a single inner rib 11 is placed between two outer ribs 12. The position of the outer ribs 12 in FIG. 5 in the toe-to-heel direction is the same position as the inner ribs 11 in the golf club head 1 in FIG. 1 through FIG. 4B, and the position of the inner rib 11 in FIG. 5 in the toe-to-heel direction is the same position as the outer rib 12 in the golf club head 1 in FIG. 1 through FIG. 4B. The length, width, height, and shape of the inner rib 11 and the outer ribs 12 in FIG. 5 are the same as the length, width, height, and shape of the inner ribs 11 and the outer rib 12 in the golf club head 1 in FIG. 1 through FIG. 4B. In every other respect, golf club head 1A is identical to golf club head 1.

Figure 6:
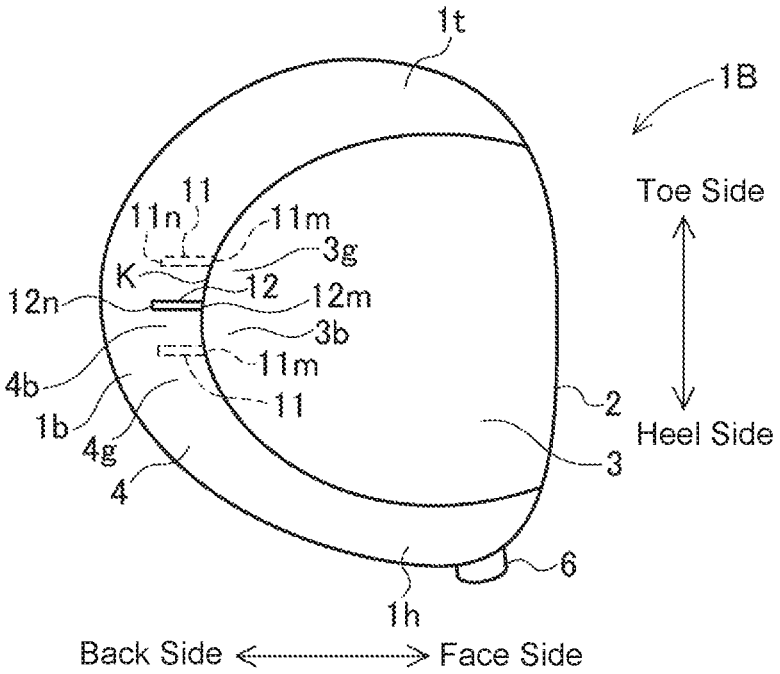
FIG. 6 is a bottom view of the golf club head in an embodiment of the present invention.

In the golf club head 1B in FIG. 6, unlike the golf club head in FIG. 1 through FIG. 4B, the inner ribs 11 and the outer rib 12 are each only provided in the back-side portion 4*b* of the side part 4. The face-side end parts 11*m*, 12*m* of the inner ribs 11 and the outer rib 12 in this golf club head 1 are positioned in the boundary portion K between the sole part 3 and the side part 4, but may also be positioned on the back side.

In every other respect, golf club head 1B is identical to golf club head 1. Note that, in a golf club head such as the one in FIG. 5, which has an inner rib 11 placed between outer ribs 12, 12, the inner rib 11 and the outer ribs 12 may be provided only in the side part 4 as in FIG. 6.

Figure 7:
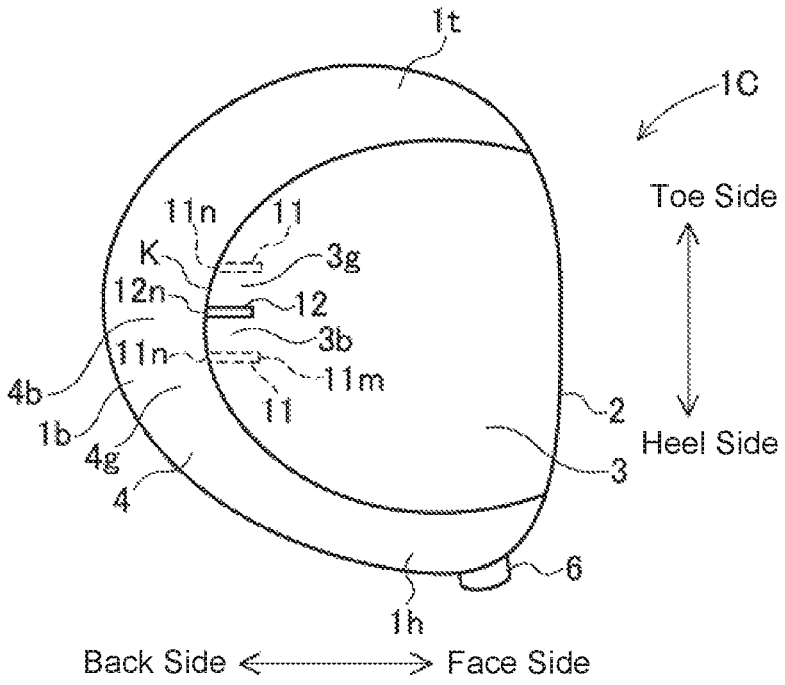
FIG. 7 is a bottom view of the golf club head in an embodiment of the present invention.

In the golf club head 1C in FIG. 7, unlike the golf club head in FIG. 1 through FIG. 4B, the inner ribs 11 and the outer rib 12 are each only provided in the back-side portion 3*b* of the sole part 3. The back-side end parts 11*n*, 12*n* of the inner ribs 11 and the outer rib 12 in this golf club head 1 are positioned in the boundary portion K between the sole part 3 and the side part 4, but may also be positioned on the face side.

In every other respect, golf club head 1C is identical to golf club head 1. Note that, in a golf club head such as the one in FIG. 5, which has an inner rib 11 placed between outer ribs 12, 12, the inner rib 11 and the outer ribs 12 may be provided only in the sole part 3 as in FIG. 7.

Figure 8A:
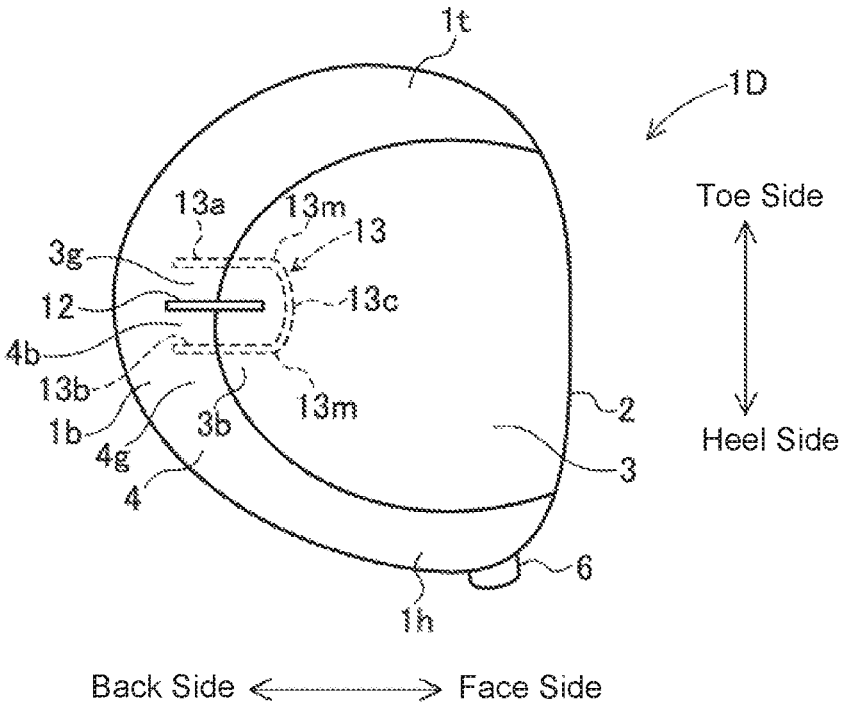
FIG. 8A is a bottom view of the golf club head in an embodiment of the present invention.
Figure 8B:
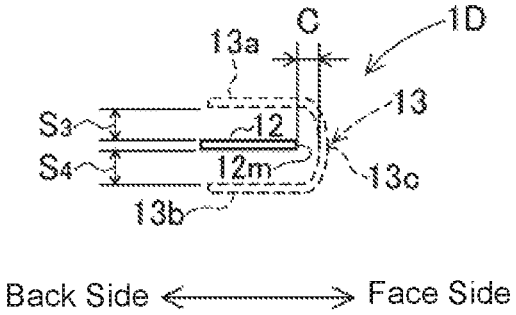
FIG. 8B is a view explaining some of the dimensions therein.

FIG. 8A is a bottom view of the golf club head 1D, and FIG. 8B is a view used to explain the environs of the inner rib 13 and the outer rib 12 in FIG. 8A. This golf club head 1D is provided with a single inner rib 13 and a single outer rib 12. The outer rib 12 is placed in the same position as the outer rib 12 in the golf club head 1 in FIG. 1 through FIG. 4B. The length, width, height, and shape of the outer rib 12 in this golf club head 1D are the same as the length, width, height, and shape of the outer rib 12 in the golf club head 1 in FIG. 1 through FIG. 4B.

The inner rib 13 is substantially U-shaped, and has two linear parts 13*a*, 13*b* extending in the face-to-back direction, and a substantially arcuate arc-shaped part 13*c* connected to the face-side end parts 13*m*, 13*m* of the linear parts 13*a*, 13*b*. The linear parts 13*a*, 13*b* are placed in the same positions as the inner ribs 11, 11 of the golf club head 1 in FIG. 1 through FIG. 4B. The central portion of the arc-shaped part 13*c* is arcuate and projects towards the face side in the toe-to-heel direction. Except for the end parts 13*m* on the face side, the length, width, height, and shape of the linear parts 13*a*, 13*b* are the same as the length, width, height, and shape of the inner ribs 11 in the golf club head 1 in FIG. 1 through FIG. 4B. There are no particular restrictions on the preferred intervals $S_3$, $S_4$ between the linear parts 13*a*, 13*b* and the outer rib 12 in the toe-to-heel direction. However, it may be 1 mm or more, specifically 5 mm or more and 30 mm or less, specifically 20 mm or less. The intervals $S_3$, $S_4$ may be the same or different.

There are no particular restrictions on the width and height of the arc-shaped part 13*c*. However, these may be the same as the width and height of the linear parts 13*a*, 13*b*.

There are no particular restrictions on the interval C between the face-side end part 12*m* of the outer rib 12 and the arc-shaped part 13*c* in the face-to-back direction. However, this may be 1 mm or more, specifically 5 mm or more and 30 mm or less, specifically 10 mm or less. In the present embodiment, interval C is the minimum distance between the outer rib 12 and the inner rib 13.

In every other respect, golf club head 1D is identical to golf club head 1. Note that the inner rib 13 and the outer rib 12 may be provided only in either the sole part 3 or the side part 4. Note also that, in a golf club head such as the one in FIG. 5, which has an inner rib 11 placed between outer ribs 12, 12, an arc-shaped part 13*c* may be provided for connecting the face-side end parts 12*m* of outer ribs 12, 12 as in FIG. 8. An arc-shaped part may also be provided to connect the back-side end parts of the ribs.

Figure 9:
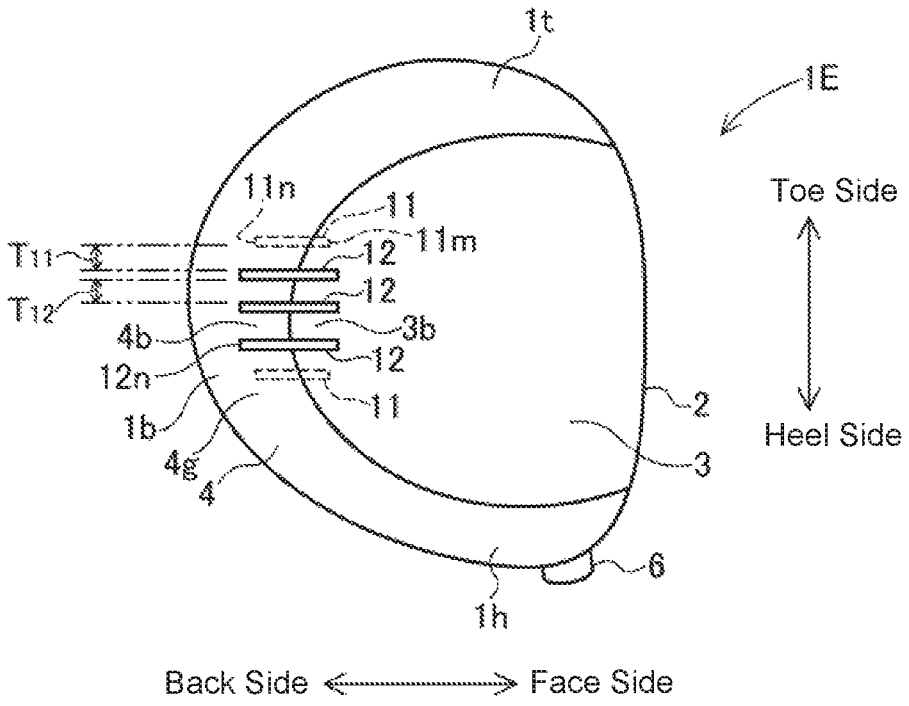
FIG. 9 is a bottom view of the golf club head in an embodiment of the present invention.

The golf club head 1E in FIG. 9 is provided with a plurality of outer ribs 12 between inner ribs 11, 11. There are no particular restrictions on the number of outer ribs 12, but from 1 to 5 may be provided. All of the inner ribs 11 and outer ribs 12 extend parallel to each other in the face-to-back direction. The length, width, height, and shape of the inner ribs 11 and the outer ribs 12 are the same as the length, width, height, and shape of the inner ribs 11 and the outer rib 12 in the golf club head 1 in FIG. 1 through FIG. 4B.

There are no particular restrictions on the interval $T_{11}$ between adjacent inner ribs 11 and outer ribs 12 in the toe-to-heel direction. However, it may be 1 mm or more, specifically 5 mm or more and 30 mm or less, specifically 20 mm or less. There are no particular restrictions on the interval $T_{12}$ between adjacent outer ribs 12 in the toe-to-heel direction. However, it may be 1 mm or more, specifically 5 mm or more and 30 mm or less, specifically 20 mm or less. In every other respect, golf club head 1E is identical to golf club head 1. Note that the inner ribs 11 and the outer ribs 12 may be provided in only the sole part 3 or the side part 4. Note that, in a golf club head such as the one in FIG. 5, which has an inner rib 11 placed between outer ribs 12, 12, a plurality of inner ribs 11 may be provided.

Figure 10:
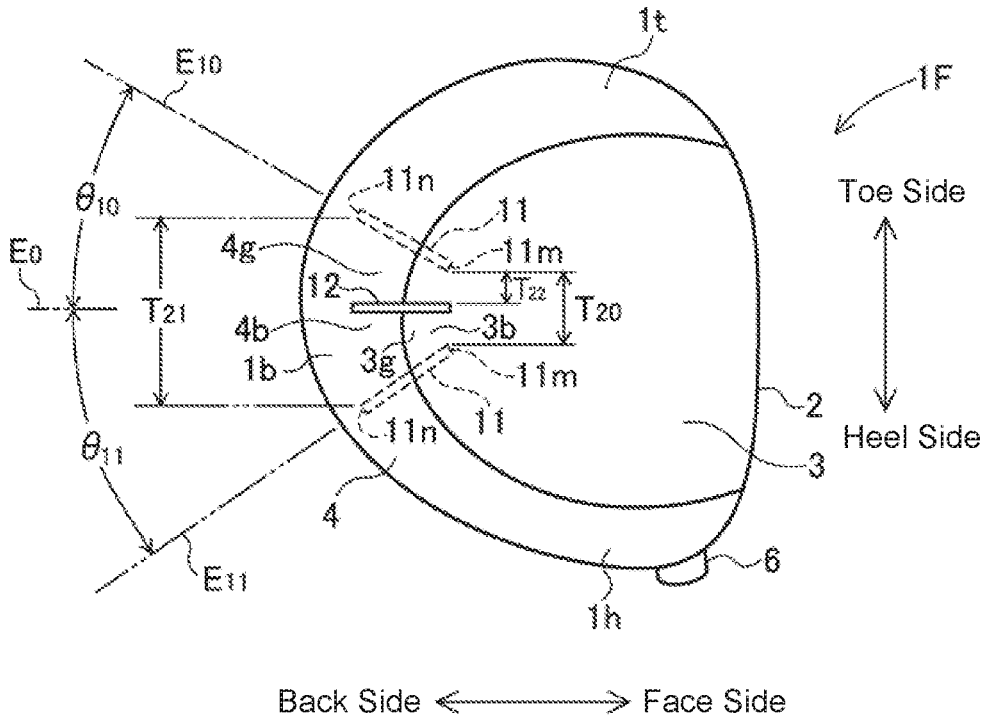
FIG. 10 is a bottom view of the golf club head in an embodiment of the present invention.

The golf club head 1F in FIG. 10 has two inner ribs 11, 11, and a single outer rib 12 placed between these ribs. In the golf club head 1F, the inner ribs 11, 11 extend in a direction inclined with respect to the face-to-back direction. When the center line $E_0$ extends in the face-to-back direction through the center of the golf club head in the toe-to-heel direction excluding the hosel part, the inner ribs 11 are inclined with respect to the center line $E_0$ such that the distance from the center line $E_0$ on the side with the back-side end part 11*n* increases, and the interval between the inner ribs 11, 11 in the toe-to-heel direction increases on the back side. There are no particular restrictions on the angle $\theta_{10}$ at which the extension direction $E_{10}$ of the inner rib 11 on the toe side intersects the center line $E_0$ in the face-to-back direction and the angle $\theta_{11}$ at which the extension direction $E_{11}$ of the inner rib 11 on the heel side intersects the center line $E_0$. However, it may be 10° or more, specifically 20° or more and 90° or less, specifically 50° or less. $\theta_{10}$ and $\theta_{11}$ may be the same or different. There are no particular restrictions on the interval $T_{20}$ in the toe-to-heel direction between the face-side end parts 11*m*, 11*m* of the inner ribs 11, 11 at the farthest point. However, it may be 4 mm or more, specifically 10 mm or more and 30 mm or less, specifically 20 mm or less. There are no particular restrictions on the interval $T_{21}$ in the toe-to-heel direction between the back-side end parts 11*n*, 11*n* of the inner ribs 11, 11 at the farthest point. However, it may be 5 mm or more, specifically 10 mm or more and 60 mm or less, specifically 40 mm or less.

The interval between each inner rib 11 and the outer rib 12 in the toe-to-heel direction is at its smallest on the face side of the inner ribs 11 and the outer rib 12 at the farthest point. There are no particular restrictions on the smallest interval $T_{22}$. However, it may be 1 mm or more, specifically 10 mm or more and 30 mm or less, specifically 20 mm or less.

The length, width, height, and shape of the outer rib 12 in the golf club head 1F are the same as the length, width, height, and shape of the outer rib 12 in the golf club head 1 in FIG. 1 through FIG. 4B. In every other respect, golf club head 1F is identical to golf club head 1.

In FIG. 10, the inner ribs 11 and the outer rib 12 are provided from the sole part 3 to the side part 4. However, at least some of these may also be provided in only the sole part 3 or the side part 4. In FIG. 10, an outer rib 12 is provided between inner ribs 11, 11. However, the configuration in FIG. 10 may also be applied to the type of golf club head in FIG. 5 in which an inner rib 11 is placed between outer ribs 12, 12.

Figure 11A:
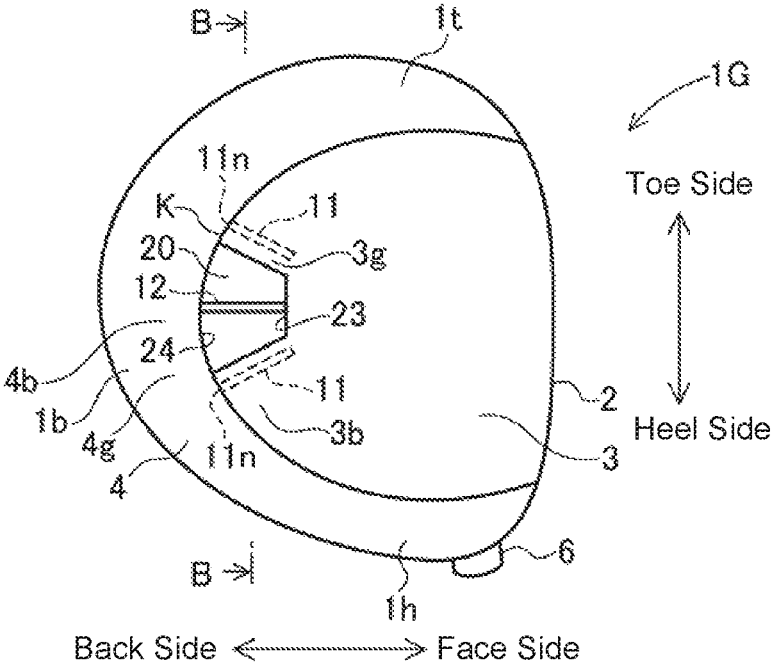
FIG. 11A is a bottom view of the golf club head in an embodiment of the present invention.
Figure 11B:
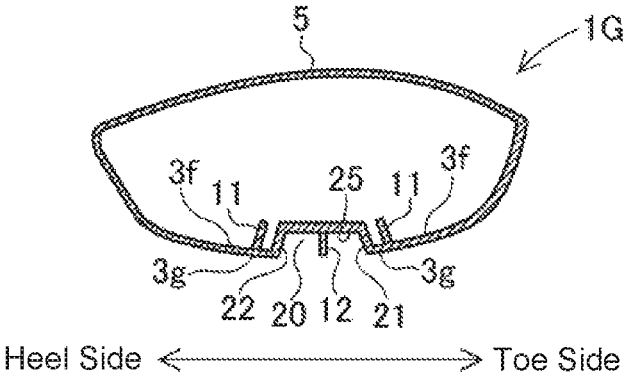
FIG. 11B is a cutaway end view along line B-B in FIG. 11A.
Figure 11C:
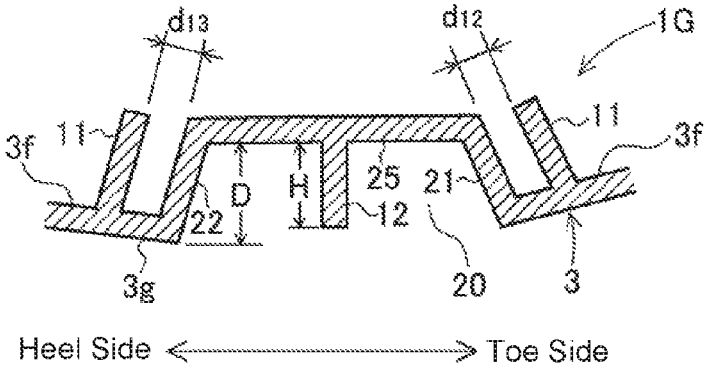
FIG. 11C is an enlarged view of a portion of FIG. 11B.
Figure 12:
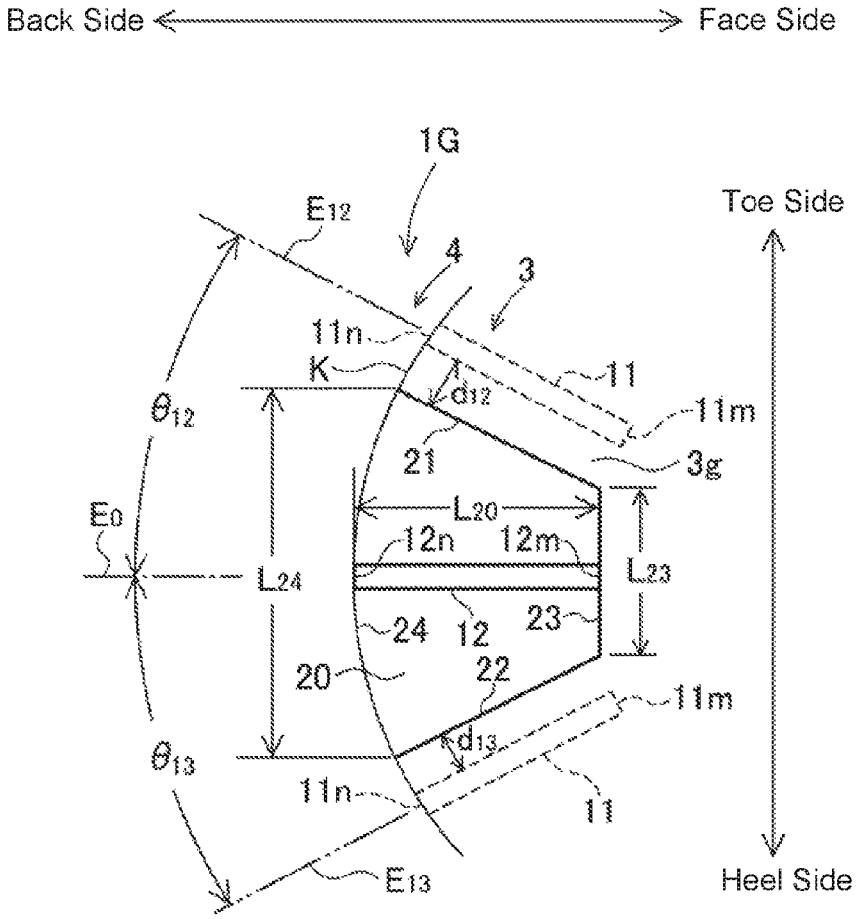
FIG. 12 is an enlarged view of a portion of FIG. 11A.

FIG. 11A is a bottom view of a golf club head 1G, FIG. 11B is a cutaway end view along line B-B in FIG. 11A, and FIG. 11C is an enlarged view of the recess part and environs in FIG. 11B. The FIGS. 11B and 11C illustrates the recess part that inwardly recessed. FIG. 12 is an enlarged view of the recess part and environs in FIG. 11A. In golf club head 1G, a recess part 20 is provided in the back side of the sole part 3, an outer rib 12 is placed inside the recess part 20, and an inner rib 11, 11 is placed on both the toe side and the heel side of the recess part 20.

The recess part 20 has side wall parts 21, 22 rising from the outer surface 3*g* of the sole part 3 on both the toe side and the heel side, a side wall part 23 on the face side, and a bottom surface 25. The boundary portion 24 is a boundary line between the bottom surface 25 and the side part 4. The outer rib 12 extending in the face-to-back direction is projected from the bottom surface 25. In the present embodiment, the face-side end part 12*m* of the outer rib 12 connects to the side wall part 23 on the face side, and the back-side end part 12*n* extends towards the boundary portion 24.

There are no particular restrictions on the average depth D of the recess part 20. However, it may be 1 mm or more, specifically 2 mm or more and 20 mm or less, specifically 15 mm or less. In the present embodiment, the recess part 20 is substantially fan-shaped in which the width $L_{23}$ on the face side in the toe-to-heel direction is smaller than the width $L_{24}$ on the back side in the toe-to-heel direction. There are no particular restrictions on the face-side width $L_{23}$. However, it may be 4 mm or more, specifically 10 mm or more and 30 mm or less, specifically 20 mm or less. There are no particular restrictions on the back-side width $L_{24}$. However, it may be from 5 mm or more, specifically 10 mm or more and 60 mm or less, specifically 40 mm or less. There are no particular restrictions on the length $L_{20}$ of the recess part 20 in the face-to-back direction. However, it may be 5 mm or more, specifically 10 mm or more and 30 mm or less, specifically 20 mm or less.

In the present embodiment, the side wall part 21 on the toe side and the inner rib 11 on the toe side are substantially parallel, and the side wall part 22 on the heel side and the inner rib 11 on the heel side are substantially parallel. There are no particular restrictions on the intersection angle $\theta_{12}$ between the extension line $E_{12}$ of the inner rib 11 on the toe side and the center line $E_0$, and the intersection angle $\theta_{13}$ between the extension line $E_{13}$ of the inner rib 11 on the heel side and the center line $E_0$. However, it may be 10° or more, specifically 20° or more and 90° or less, specifically 50° or less. There are no particular restrictions on the interval $d_{12}$ between the inner rib 11 on the toe side and the side wall part 21 on the toe side. However, it may be 1 mm or more, specifically 5 mm or more and 20 mm or less, specifically 10 mm or less. There are no particular restrictions on the interval $d_{13}$ between the inner rib 11 on the heel side and the side wall part 22 on the heel side. However, it may be 1 mm or more, specifically 5 mm or more and 20 mm or less, specifically 10 mm or less.

The inner ribs 11 project from the inner surface 3*f* of the back-side portion 3*b* of the sole part 3. The back-side end part 11*n* of the inner ribs 11 is located in the boundary portion K between the sole part 3 and the side part 4, but may be located closer to the face side than the boundary. The length, width, height, and shape of the inner ribs 11 here are the same as the length, width, height, and shape of the inner ribs 11 in the golf club head 1 in FIG. 1 through FIG. 4B.

The projection height H of the outer rib 12 from the bottom surface 25 is preferably equal to or less than the depth D of the recess part 22.

In the present embodiment, a recess part 20 is provided, and an outer rib 12 is provided inside the recess part 20. As a result, the outer rib 12 does not project from the outer surface 3*g* of the sole part 3. When the outer rib projects from the sole part, it sometimes affects the orientation of the face surface when the golf club head is at address. The side wall parts 21, 22 of the recess part 20 in the toe side and the heel side also have the same rigidity-improving effect on the sole part 3 as an inner rib 11 and an outer rib 12. As a result, the launch angle of the ball is increased.

In FIG. 11 and FIG. 12, the recess part 20 and the outer rib 12 are only provided in the sole part 3. However, they may be provided continuously from the back-side portion 3*b* of the sole part 3 to the back-side portion 4*b* of the side part 4. Alternatively, the recess part 20 and the outer rib 12 may be provided only in the back-side portion 4*b* of the side part 4. The recess part 20 does not have to be fan-shaped. It may also be rectangular or square. In FIG. 11 and FIG. 12, each side wall part 21, 22 of the recess part 20 and each inner rib 11 is inclined relative to the face-to-back direction. However, they may include portions that are not inclined in the face-to-back direction. In FIG. 11 and FIG. 12, a single outer rib 12 is provided. However, two or more outer ribs may also be provided. Three or more inner ribs 11 may also be provided. An inner rib may also be provided on the bottom surface 25.

The embodiments described above are examples of the present invention, and the present invention may have a structure other than those illustrated in the drawings. For example, there may be some other number of inner ribs and outer ribs. There may be inner ribs 13 extending in a substantially U-shaped manner in addition to linear inner ribs 11. There may be outer ribs extending in a substantially U-shaped manner in addition to linear outer ribs 12.

When a plurality of inner ribs and a plurality of outer ribs are provided, the inner ribs and the outer ribs may alternate in the toe-to-heel direction. When there is a plurality of outer ribs, at least one of the outer ribs may be inclined relative to the face-to-back direction so that the interval between outer ribs 12, 12 increases towards the back side. In FIG. 10 through FIG. 12, the inner ribs 11 are linear. However, the inner ribs 11 may extend in the face-to-back direction on the face side and then bend so as to become inclined relative to the face-to-back direction on the back side.

The face-side end parts of the inner ribs 11, 13 and the outer rib 12 may be positioned more on the face side than shown in the drawings. For example, they may be placed in the immediate vicinity of the face part 2 and may even connect to the face part 2.

In addition to a driver, the present invention can be applied to the head of a fairway wood or a utility club.

In the invention, the inner and outer ribs may be arranged only either on the side part or sole part. These ribs may extend to the crown part from the side part, or from the sole part through the side part.

What is claimed is:

1. A hollow golf club head having a face part, a sole part, a side part, a crown part, and a hosel part, comprising:

one or more of inner ribs that are disposed on at least one of the sole part and the side part and that inwardly project from an inner surface of the one of the sole part and the side part, one or more of outer ribs that are disposed on at least the one of the sole part and the side part and that outwardly project from an outer surface of the one of the sole part and the side part, wherein one of the outer ribs is arranged between the inner ribs in a toe-to-heel direction, a recess part, which is inwardly recessed, is provided on at least one of the sole part and the side part, one of the outer ribs is arranged in the recess part, and the recess part is arranged between two of the inner ribs in the toe-to-heel direction.

2. The hollow golf club head of claim 1, wherein the inner ribs are two or more, and at least two of the inner ribs are separately arranged.

3. The golf club head according to claim 1, wherein the inner ribs and the outer ribs each have an extending portion in a face-to-back direction.

4. The golf club head according to claim 1, wherein at least one of the inner ribs and the outer ribs has a portion inclined with respect to a face-to-back direction.

5. The golf club head according to claim 1, wherein a recess part, which is inwardly recessed, is provided on at least one of the sole part and the side part, and one of the outer ribs is arranged in the recess part.

6. The golf club head according to claim 1, wherein the inner ribs are inclined with respect to a center line ($E_0$) that extends in a face-to-back direction and is positioned at a middle of the golf club head in the toe-to-heel direction such that distances from the center line to the inner ribs increase as approaching a back side of the golf club head.

7. The golf club head according to claim 1, wherein a length of the inner ribs is 5 mm or more and 100 mm or less, a height of the inner ribs is 0.5 mm or more and 10 mm or less, an average amount of widths of the inner ribs is 0.5 mm or more and 3 mm or less, a length of the outer ribs is 5 mm or more and 80 mm or less, a height of the outer ribs is 0.3 mm or more and 10 mm or less, an average amount of widths of the outer ribs is 0.5 mm or more and 4 mm or less.

* * * * *